US009027269B2

(12) United States Patent
Budzar et al.

(10) Patent No.: US 9,027,269 B2
(45) Date of Patent: May 12, 2015

(54) POP-UP GREETING CARDS WITH CONFETTI

(71) Applicant: American Greetings Corporation, Cleveland, OH (US)

(72) Inventors: Lauren Budzar, Seven Hills, OH (US); John Talbot, Bay Village, OH (US); Lynne Shlonsky, Shaker Heights, OH (US); Melissa Flesher, Avon, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/466,605

(22) Filed: Aug. 22, 2014

(65) Prior Publication Data

US 2014/0366410 A1 Dec. 18, 2014

Related U.S. Application Data

(63) Continuation-in-part of application No. 13/470,499, filed on May 14, 2012, which is a continuation-in-part of application No. 12/974,287, filed on Dec. 21, 2010, now Pat. No. 8,322,058.

(60) Provisional application No. 61/888,193, filed on Oct. 8, 2013, provisional application No. 61/485,298, filed on May 12, 2011.

(51) Int. Cl.

| | |
|---|---|
| ***A63H 37/00*** | (2006.01) |
| ***B42D 15/02*** | (2006.01) |
| ***B42D 15/04*** | (2006.01) |

(52) U.S. Cl.

CPC ..... *B42D 15/022* (2013.01); *B42D 15/04* (2013.01)

(58) Field of Classification Search

CPC ..... G09F 1/06; G09F 1/08; G09F 1/04; B42D 15/042; B42D 15/045; A63H 37/00; A63H 13/16

USPC ..... 40/124.02, 124.06, 124.08, 427; 446/475, 148; 472/52, 54

See application file for complete search history.

(56) References Cited

U.S. PATENT DOCUMENTS

| | | | | |
|---|---|---|---|---|
| 4,787,160 | A | 11/1988 | Balsamo | |
| 5,120,263 | A * | 6/1992 | Ierfino et al. | 446/486 |
| 5,199,745 | A | 4/1993 | Balsamo | |
| 5,263,890 | A | 11/1993 | Dent | |
| 5,487,706 | A * | 1/1996 | Wilk | 472/54 |
| 5,954,563 | A * | 9/1999 | Spriggs | 446/475 |

(Continued)

FOREIGN PATENT DOCUMENTS

| | | | |
|---|---|---|---|
| FR | 2699860 | A1 * | 7/1994 |
| FR | 2790423 | A1 * | 9/2000 |

(Continued)

*Primary Examiner* — Casandra Davis
(74) *Attorney, Agent, or Firm* — Christine Flanagan

(57) ABSTRACT

An interactive electronic greeting card with pop up feature includes a three-sided pocket or cavity which houses various electronic and mechanical components and a pop up element. In a first position, the pop up element is substantially contained within the greeting card pocket or cavity. When the push button is depressed, the pop up element is ejected or "pops up" out of the greeting card pocket or cavity, revealing a greeting or other printed indicia. The push button also initiates playback of a pre-loaded digital audio file, which may be a spoken message, a sound, a song, music or other such audio recording.

14 Claims, 12 Drawing Sheets

(56) References Cited

U.S. PATENT DOCUMENTS

| | | | | |
|---|---|---|---|---|
| 6,001,019 | A * | 12/1999 | Al-Bannai | 472/54 |
| 6,869,369 | B2 * | 3/2005 | Fairweather | 472/52 |
| 6,966,135 | B1 | 11/2005 | McDonald | |
| 7,546,702 | B2 | 6/2009 | Malkovas | |
| 7,552,553 | B2 | 6/2009 | Kelly | |
| 7,634,864 | B2 * | 12/2009 | Segan | 40/124.03 |
| 7,694,445 | B2 | 4/2010 | Kelly | |
| 7,717,347 | B2 | 5/2010 | Boyd et al. | |
| 7,793,446 | B2 | 9/2010 | Hluchan | |
| 7,861,441 | B1 | 1/2011 | Hoellwarth | |
| 2006/0135037 | A1 * | 6/2006 | Newland et al. | 446/475 |
| 2007/0173172 | A1 * | 7/2007 | Yu et al. | 446/303 |
| 2007/0284269 | A1 | 12/2007 | Star | |
| 2008/0118900 | A1 * | 5/2008 | Salerni | 434/258 |
| 2008/0229633 | A1 | 9/2008 | Yi | |
| 2009/0214802 | A1 | 8/2009 | Sedlacko | |
| 2009/0217559 | A1 | 9/2009 | Sayre | |
| 2011/0126437 | A1 | 6/2011 | Bullington | |
| 2012/0048766 | A1 | 3/2012 | Glass | |
| 2013/0263481 | A1 * | 10/2013 | Nwosu | 40/124.06 |

FOREIGN PATENT DOCUMENTS

| | | | |
|---|---|---|---|
| GB | 2336808 | A * | 11/1999 |
| JP | 2004017312 | A * | 1/2004 |
| WO | WO 02/43966 | | 6/2002 |

* cited by examiner

POP-UP GREETING CARDS WITH CONFETTI

RELATED APPLICATIONS

This application is a continuation-in-part of U.S. patent application Ser. No. 13/470,499 filed on May 14, 2012, which is the non-provisional of U.S. Provisional Patent Application No. 61/485,298 filed on May 12, 2011 and also a continuation-in-part of U.S. patent application Ser. No. 12/974,287, filed on Dec. 21, 2010 (now U.S. Pat. No. 8,322,058). Copies of the above-referenced patent documents are incorporated herein by reference in their entirety.

FIELD OF THE INVENTION

The present invention is in the field of social expression and entertainment products, and more specifically to greeting cards with mechanical and electronic functions and features.

BACKGROUND OF THE INVENTION

Traditional paper greeting cards have been widely used for celebratory occasions such as birthdays, graduations, weddings, and for other commercial purposes. More recently, the market has expanded with greeting cards that attempt to capture attention by alternate designs and other features to enhance the communicative and entertainment value of social and relational greetings. The widespread availability of compact digital electronics has made incorporation into social communication products economical. Although the prior art includes greeting cards with sound-generating features, such cards are generally available only in a fixed format wherein a sound file is played upon activation by manipulation of the card. Cards with mechanical or structural features such as three-dimensional "pop-ups" are conventionally made with multiple panels or pages which are attached at various locations to unfold in multiple planes. A particular challenge to incorporate mechanical movement in a greeting card is to do so without making the card too bulky or thick, so that it has the same general configuration and size as conventional flat panel cards.

SUMMARY OF THE INVENTION

An interactive electronic greeting card with pop up feature includes a pocket or cavity which houses various electronic and mechanical components and a pop-up element. In a first position, the pop-up element is substantially contained within the greeting card pocket or cavity. In a second position, the pop-up element is substantially outside the greeting card pocket or cavity. A push button controls movement of the pop-up element between the first and second positions. Pressing the push button causes the pop-up element to be ejected or to "pop up" out of the greeting card pocket or cavity, revealing a greeting or other printed indicia. The push button also initiates playback of a pre-loaded digital audio file, which may be a spoken message, a sound, a song, music or other such audio recording. Manually pushing the pop-up element back into the cavity ends playback of the audio.

DETAILED DESCRIPTION OF PREFERRED AND ALTERNATE EMBODIMENTS

The greeting card of the present invention combines a spring loaded pop-up element and sound capability with a greeting card having push button activation. The push button requires user interaction with the greeting card in order to reveal the pop-up element and to initiate playback of a pre-loaded digital sound file. The pop up element is retained inside a pocket or cavity of the greeting card and a spring loaded mechanism controls the movement of the pop-up element between a first position concealed within a pocket or cavity of the greeting card and a second position wherein a significant portion of the pop-up element is ejected from the pocket or cavity.

Figure 2:
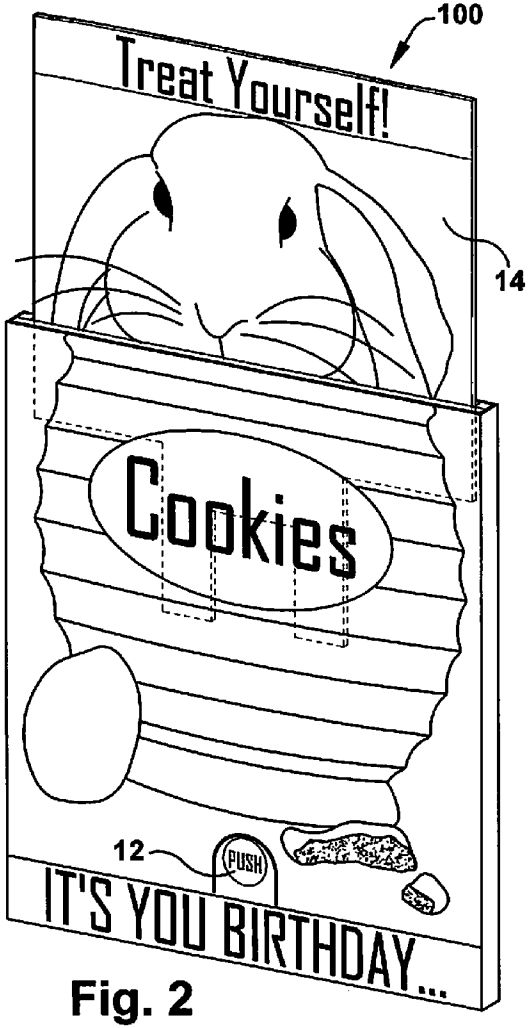
FIG. 2 is a perspective view of the Pop-Up Greeting Card of FIG. 1, in a second position.
Figure 1:
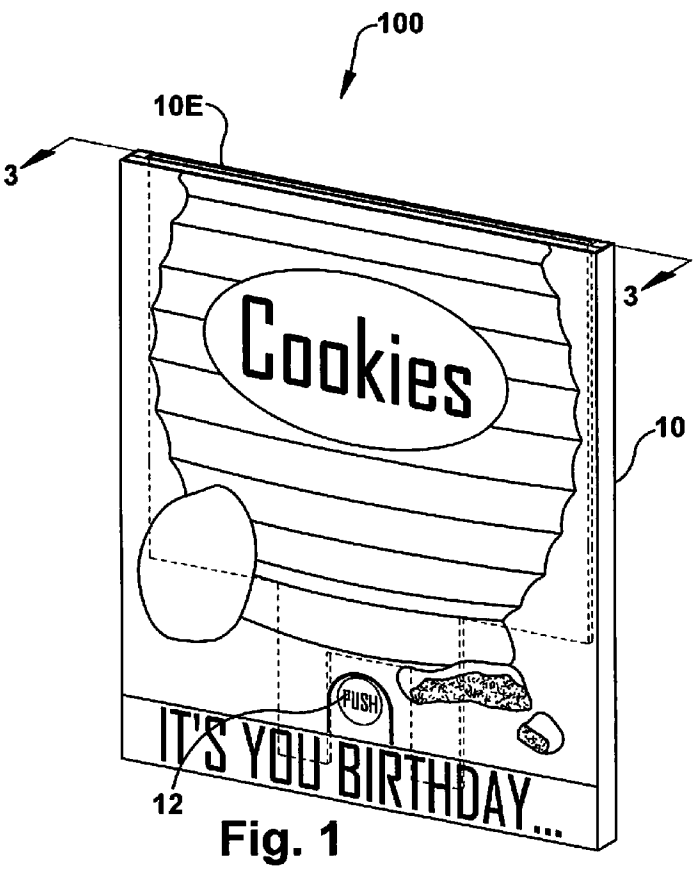
FIG. 1 is a perspective view of a first embodiment of the Pop-Up Greeting Card of the present invention, in a first position.
Figure 3:
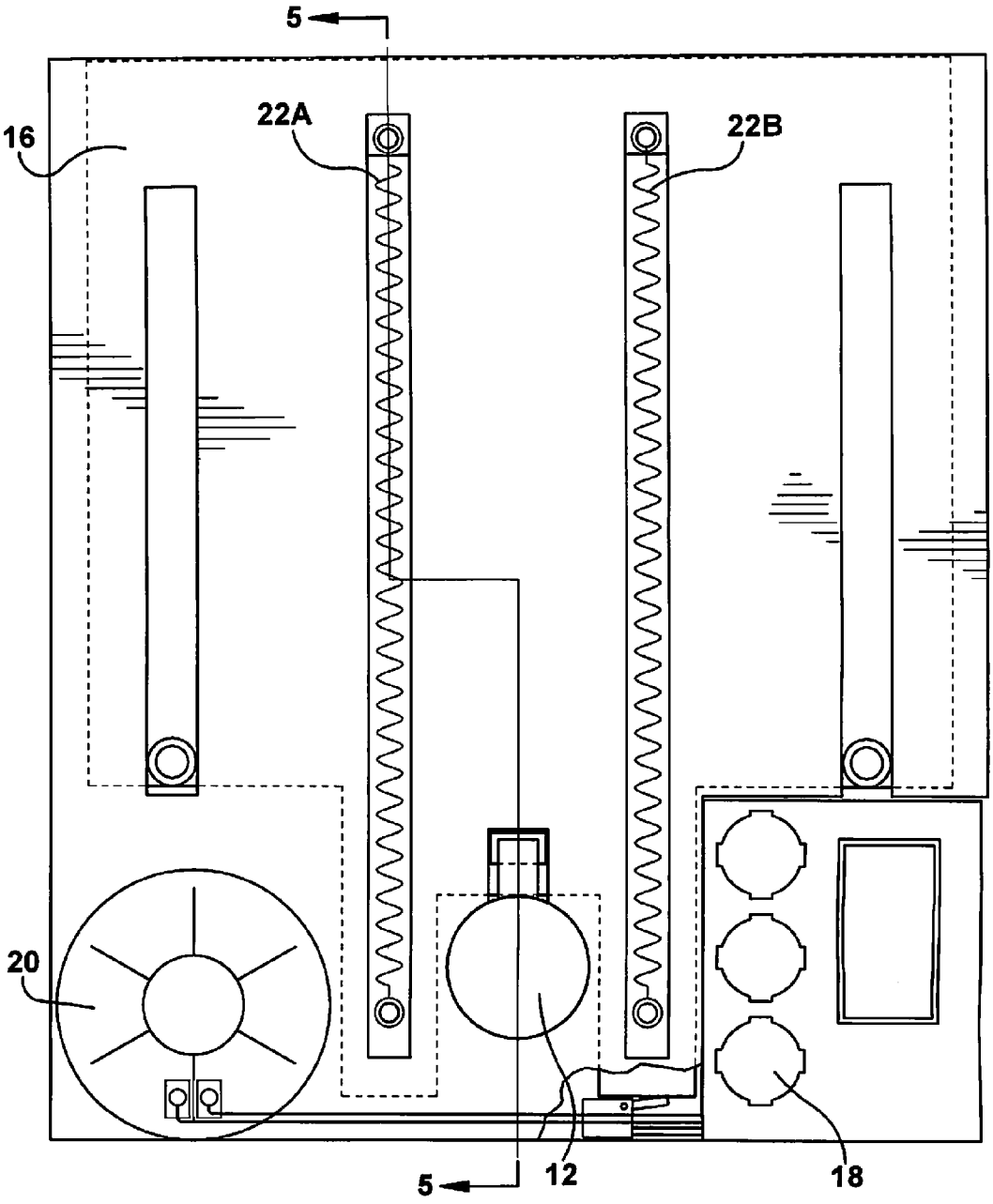
FIG. 3 is a front view of the internal components of the Pop-Up Greeting Card of FIG. 1.
Figure 4:
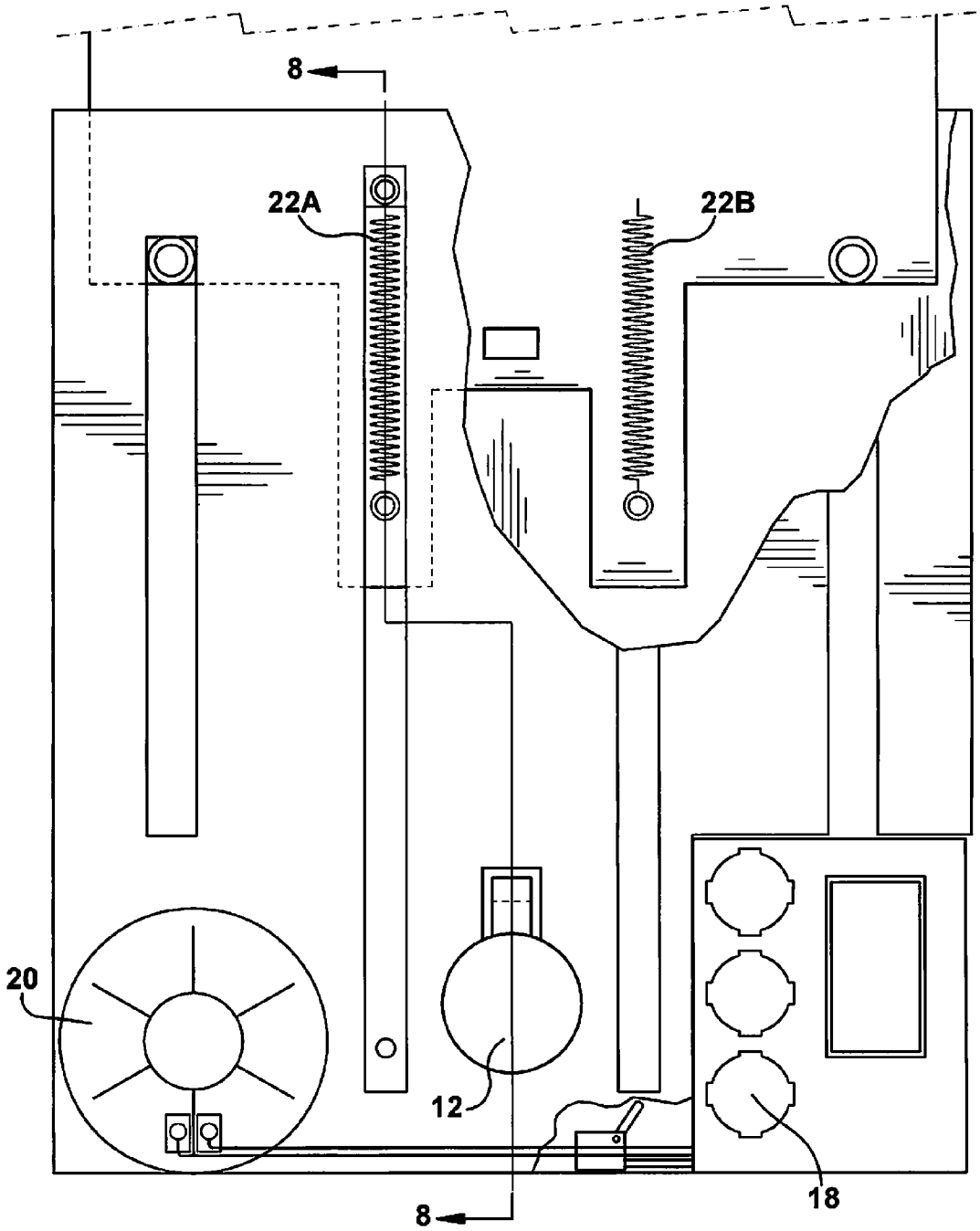
FIG. 4 is a front view of the internal components of the Pop-Up Greeting Card of FIG. 2.
Figure 5:
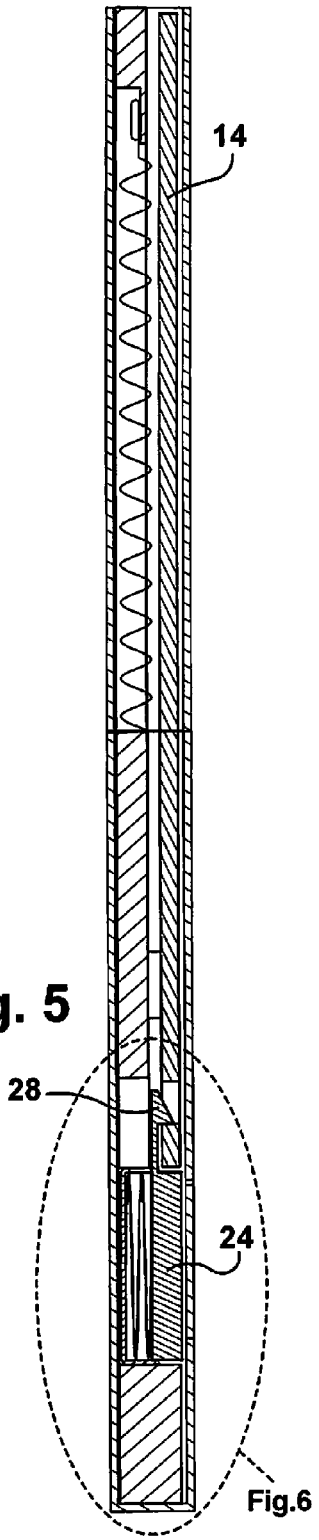
FIG. 5 is a cross-section of FIG. 3, viewed in the direction of arrows 5-5.
Figure 6:
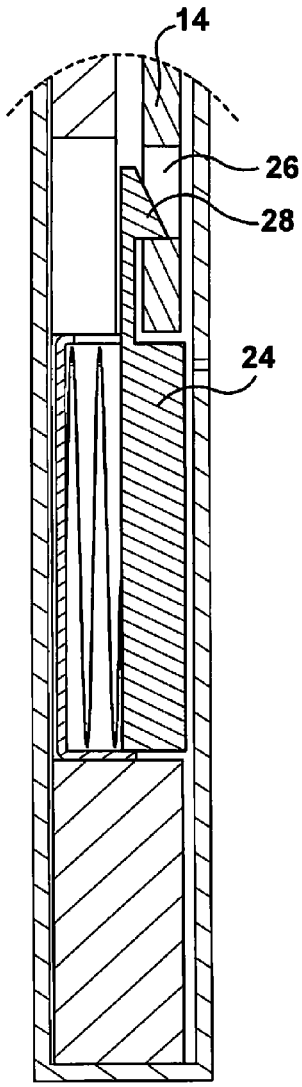
FIG. 6 is a close up view of a portion of FIG. 5.
Figure 7:
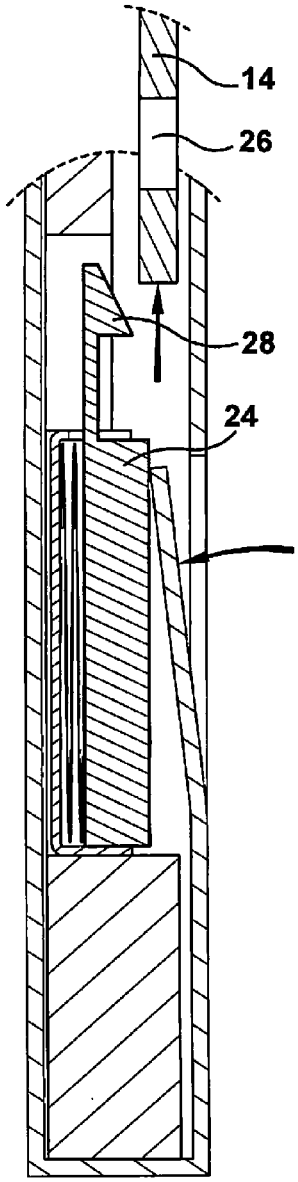
FIG. 7 is a close up view of a portion of FIG. 8.
Figure 8:
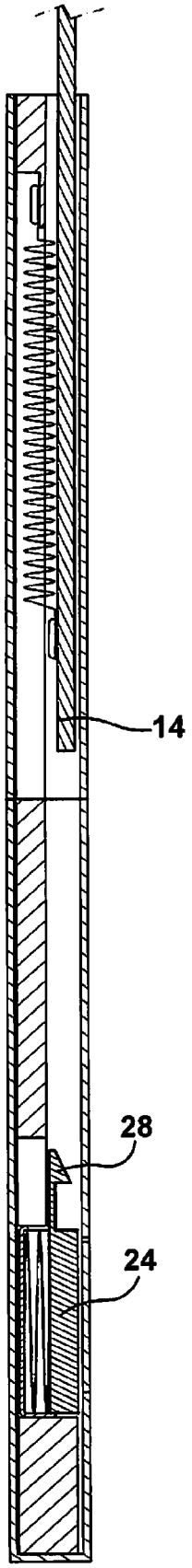
FIG. 8 is a cross-section of FIG. 4, viewed in the direction of arrows 8-8.

In one embodiment, shown in FIGS. 1 and 2, the greeting card body 10 has a front surface, a back surface parallel to and spaced apart from the front surface, and right, left and bottom side walls which extend between the front and back surfaces of the greeting card 100, creating a three sided pocket or cavity contained therein. A top edge 10E of the greeting card 100 is opened to accommodate the insertion and retraction of a pop-up element 14. The pocket or cavity is created by the three sided enclosure which, in a preferred embodiment is made of paperboard or other strong but lightweight material. Inside the pocket or cavity is contained a protective cardboard frame 16 for housing or accommodating electronic components, a push button 12 and spring activation mechanism or other activation mechanism, and a pop-up element 14. For example, the frame 16 can be made from one or more pieces of paperboard with appropriate cut-outs or openings which can be positioned between the front and back panels of the card to hold and secure the mechanical and electronic components of the card. The frame 16 contains a front panel and a back panel, both panels having various slots or openings strategically placed thereon to accommodate the various components of the greeting card 100. The front panel is parallel to and spaced apart from the back panel. In the space between the front and back panels are contained various components of the greeting card 100. In areas where no components are located, a piece of foam, cardboard, paperboard or other material may be used between the two panels to keep a consistent space between the panels. The electronic components may include a circuit board with integrated circuit and controller, memory storage device upon which at least one digital audio file is pre-loaded and saved, a power source, such as one or more batteries 18, a speaker 20, related circuitry and any other electronic component which may be required to store and replay one or more audio files, as are known to one with skill in the art. The pop-up element 14, in this particular embodiment, is a decorated panel having printed text, such as a birthday greeting and/or drawings or artwork contained thereon. The panel 14 is positioned between the front and back panels of the protective frame 16. The spring loaded mechanism includes two springs 22A, 22B which are attached at a first end to the bottom of the pop-up element or panel 14 and at a second end to an upper region of the protective frame 16. When the pop-up element 14 is in a first position substantially concealed within the greeting card, as shown in FIG. 1, the springs are stretched out, as shown in FIG. 3. A push button mechanism is contained between the protective panels 16 and contains a push button 12 that is connected to a catch or an arm 24. The catch or arm 24 of the push button mechanism contains a lip 28 that extends outward in a forward direction. The pop-up element or inner panel 14 contains a small opening 26 thereon so that when the pop up element 14 is in a first position substantially concealed within the greeting card 100, i.e., between the front and back panels of the card and within or proximate to the frame, the lip 28 of the catch or arm 24 extends into the opening 26 on the pop-up element or inner panel 14, thereby retaining the panel 14 within the greeting card 100 with the springs 22A, 22B in an extended or stretched position, as shown in FIGS. 3, 5 and 6. When the push button 12 is depressed it moves the catch or arm 24 causing the lip to become disengaged with the opening 26 on the pop-up element 14, releasing the springs 22A, 22B, as shown in FIGS. 4, 7 and 8. The mechanical energy stored in the springs 22A, 22B when they are in an extended or stretched state, propel or eject the pop-up element 14 upward through the opening along the upper edge 10E of the greeting card body 10. In addition to causing the pop-up element 14 to be revealed through the top of the greeting card 100, the press button 12 also initiates playback of the at least one pre-loaded audio file. The audio file may contain a spoken message, a song, music, various sounds, etc. When the pop-up element 14 is pushed back down and secured inside the greeting card 100, playback of the audio ends.

Figure 9:
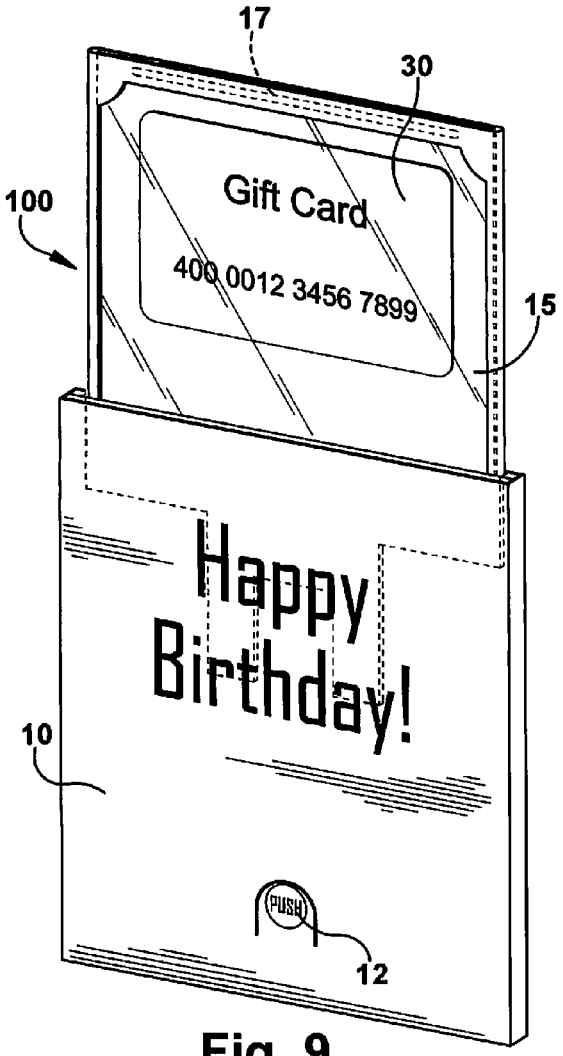
FIG. 9 is an alternate embodiment of the Pop-Up Greeting Card of the present invention.
Figure 11:
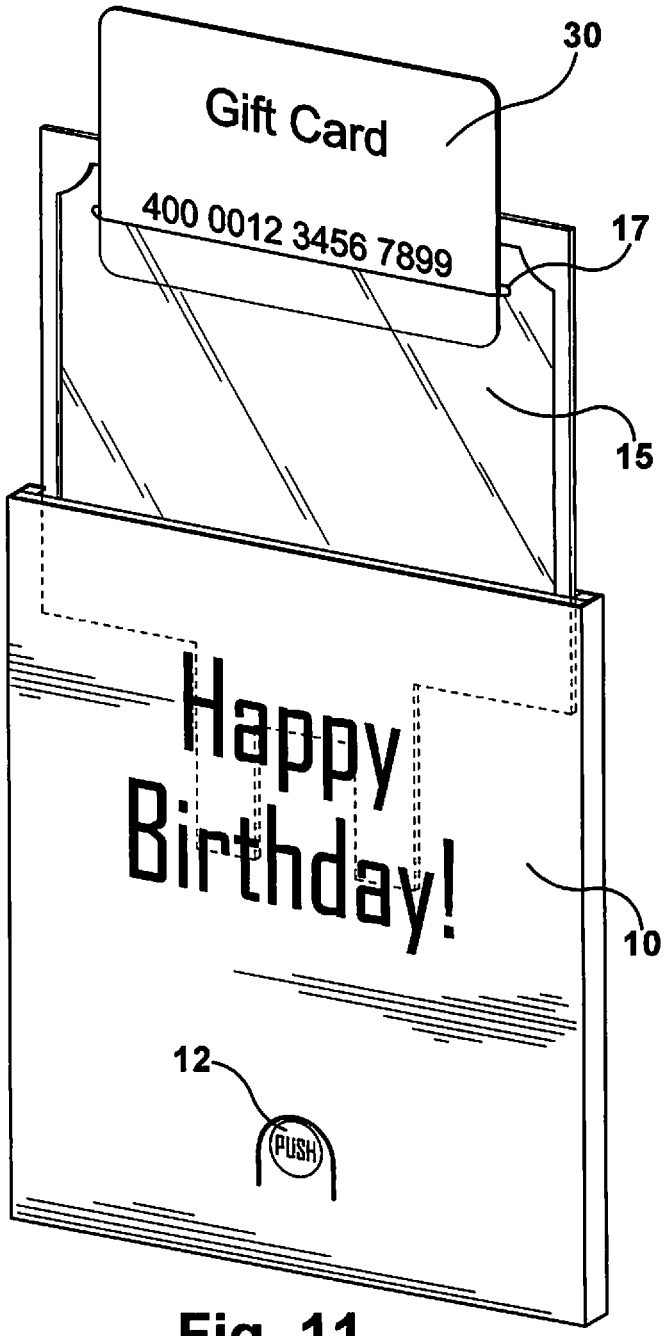
FIG. 11 is a perspective view of the Pop-Up Greeting Card of FIG. 9 with a gift card partially removed from a cavity.

In an alternate embodiment, shown in FIGS. 9 and 11, the greeting card of the present invention includes a pop-up element 15 which serves as a pocket or cavity wherein a gift card 30 may be inserted for presentation to the greeting card recipient. The greeting card body 10 may include, as described above, a main pocket or cavity which contains a front side, a back side which is parallel and spaced apart from the front side, and a right, back and bottom side which extend between the front and back panels along three side edges, thereby creating a three-sided pocket. The top of the greeting card is open for inserting the pop-up element 15. The pop-up element 15 is in itself another pocket or cavity which is operative to contain a standard sized gift card 30. The pop-up cavity 15 may contain a front surface which contains an opening thereon through which the gift card 30 is visible, or the pop-up cavity 15 may contain a front surface which contains an opening thereon which is covered with acetate or other clear, transparent material, through which the gift card 30 is visible. Alternatively the entire pop-up cavity 15 may be made of acetate or other clear, transparent material. The pop-up cavity 15 may be closed on all sides to prevent accidental removal of the gift card, with a slot 17 or flap or tab removably attached along a top surface which can be used to open the cavity 15 and remove the gift card 30. The cavity 15 may also be a three-sided cavity with a completely open top edge for removal of the gift card 30. The pop-up cavity 15 is larger than the measurements of a standard gift card, which are approximately 5¼ inches high and 3⅝ inches wide. Alternatively, the pop-up element may be a single panel, as described above, with a gift card 30 removably attached thereto. The spring and push button mechanism described above, may be used to move the pop-up cavity 15 (with gift card 30 therein) between a first position wherein the pop-up cavity 15 is substantially concealed within the main greeting card pocket or cavity and a second position wherein the pop-up cavity 15 is substantially outside of the main greeting card pocket or cavity. The protective frame construct, also described above, may also be used in this embodiment to protect the various inner components of the greeting card 100. This embodiment may also include a sound module contained within the main pocket or cavity which is operative to store and playback at least one pre-recorded audio file.

Figure 10:
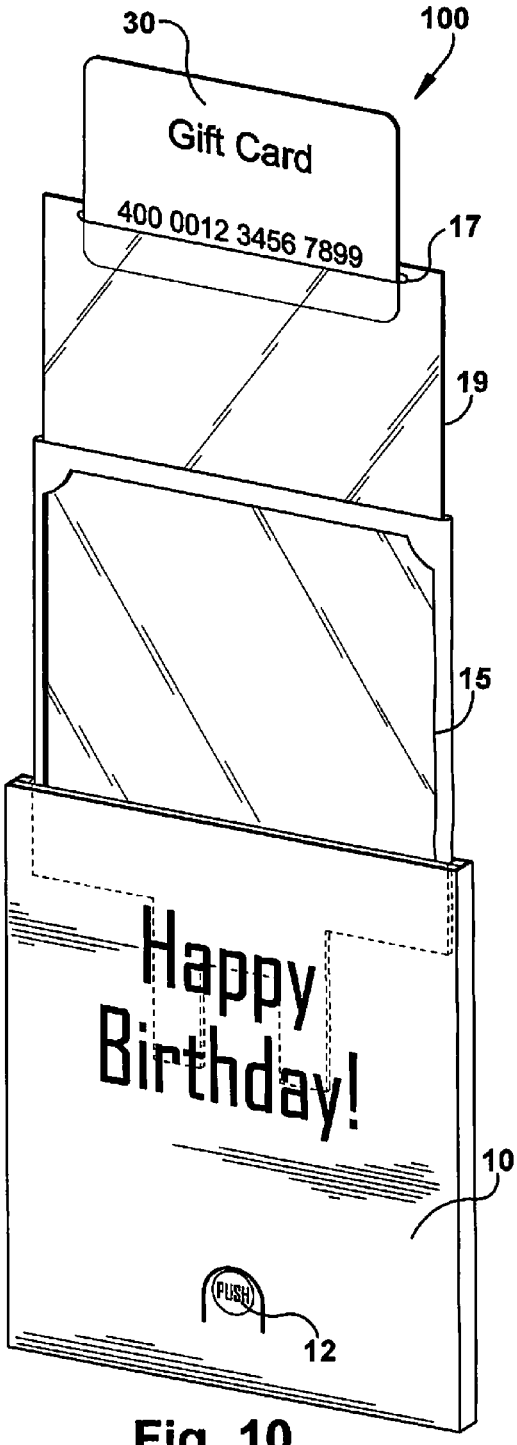
FIG. 10 is an alternate embodiment of the Pop-Up Greeting Card of the present invention.

In still another embodiment, shown in FIG. 10 the greeting card 100 includes two or more telescoping pockets or panels 19 which telescope in an inward and outward direction with respect to one another. The smallest or innermost pocket may contain a gift card 30 therein or removably attached thereto. Alternately, the gift card 30 may be configured to fit within the smallest or innermost pocket 19 and it may be ejected from said pocket 19 upon pushing the press button 12. The first or main pocket or cavity 10 serves as the outer surface of the greeting card 100, as described above with reference to the other embodiments, and therefore is the largest of the pockets or panels of the greeting card 100. All of the other pockets or cavities 19 of the greeting card 100 are sized to fit within the first or main pocket 10 of the greeting card 100. After the first or main pocket 10, each successive pocket or cavity 19 is slightly smaller in size than the previous pocket or cavity such that each successive pocket or cavity 19 fits within the previous pocket. The main pocket or cavity 10, as described above, may have a front side, a back side parallel to and spaced apart from the front side and right, left and bottom sides which extend between the front and back panels along three side edges of the main panel or cavity. The spring and push button mechanism described above with respect to the other embodiments can be used to move the two or more inner pockets or cavities from a first position wherein the inner pockets or cavities are substantially contained and concealed within the main pocket or cavity and a second position, wherein the two or more inner pockets or cavities are substantially outside of the main pocket or cavity. The protective frame described above may also be used with this embodiment to protect the various internal components of the greeting card. This embodiment may also contain a sound module, as described above, which is operative to replay a pre-recorded audio file upon pressing the press button. Alternatively, instead of a gift card, the pocket or pockets may contain a smaller greeting card, small token gift or other novelty which can be fit within one or more of the inner pockets.

In yet another embodiment, shown in FIGS. 12-16, the greeting card described herein combines a spring loaded pop-up element which contains confetti which is ejected or dispersed when the user activates a switch mechanism, which in a preferred embodiment, is a press button switch. The switch may also activate sound simultaneously with ejecting the confetti. The pop up element is retained inside a pocket or cavity of the greeting card and a spring loaded mechanism controls the movement of the pop-up element between a first position concealed within a pocket or cavity of the greeting card and a second position wherein a significant portion of the pop-up element is ejected from the pocket or cavity while scattering confetti around the area of the greeting card.

Figure 12:
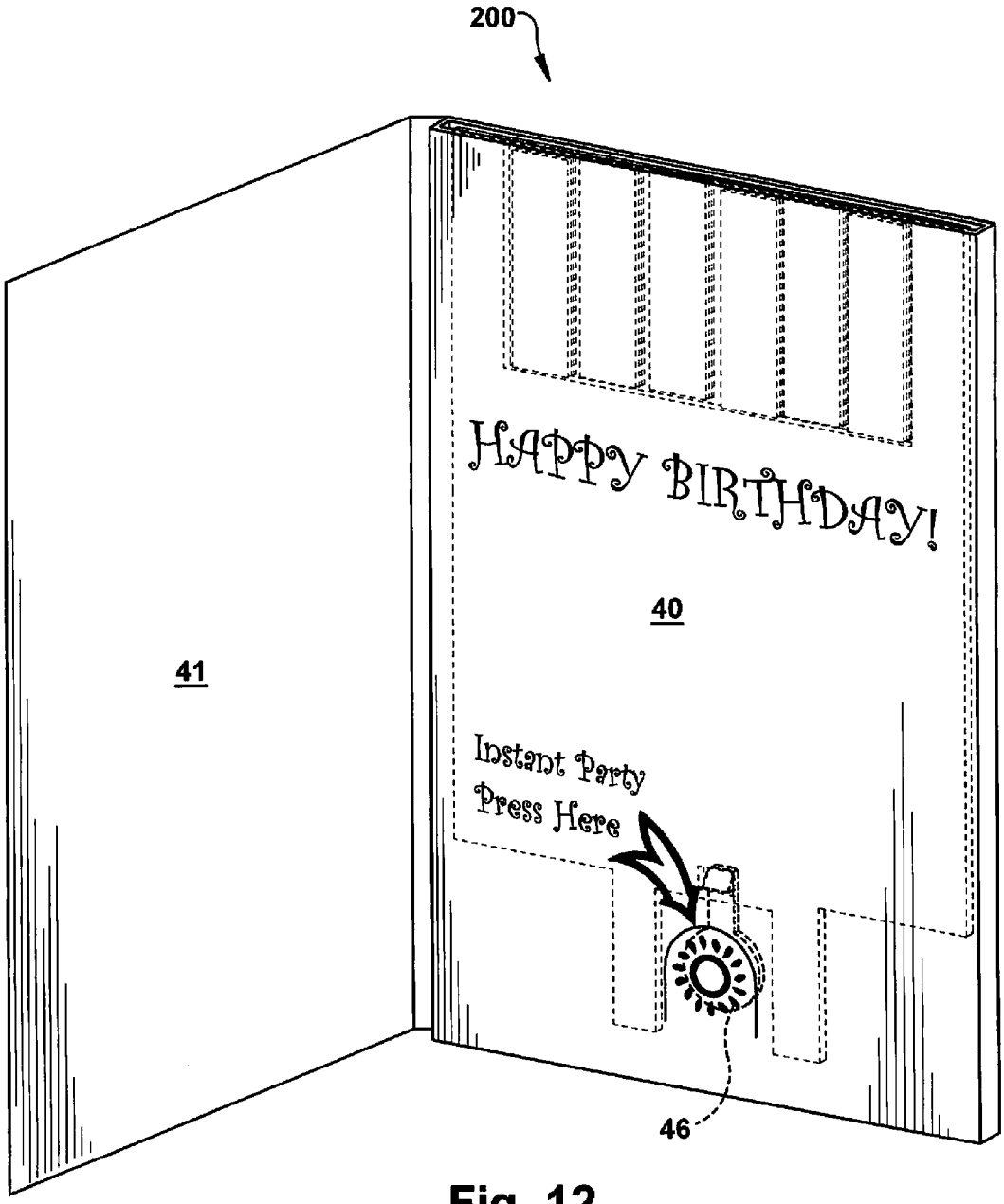
FIG. 12 is a perspective view of an alternate embodiment of the Pop-Up Greeting Card of the present invention.
Figure 13:
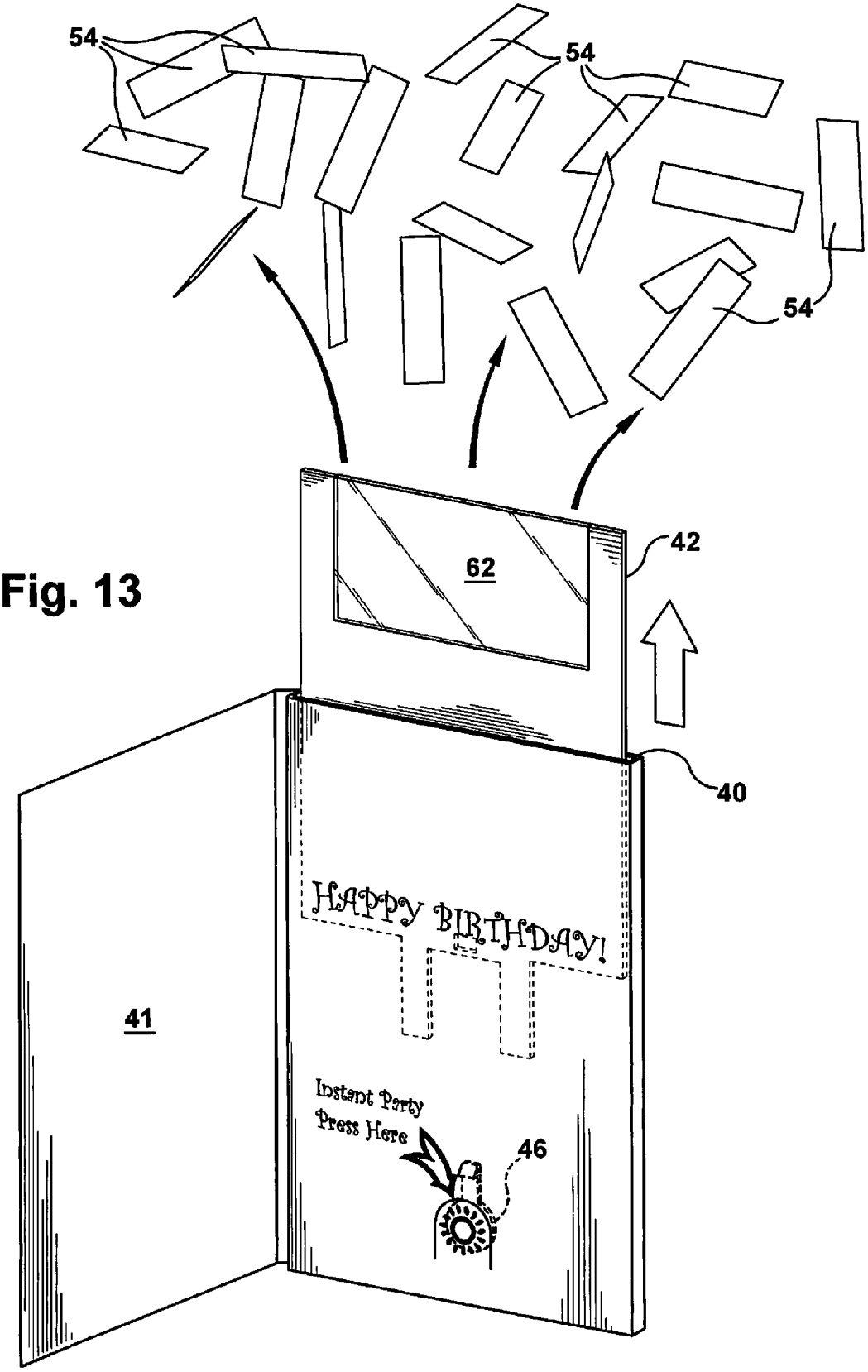
FIG. 13 is a perspective view of the Pop-Up Greeting Card of FIG. 12, with ejected panel and confetti.

In this embodiment, the greeting card body contains a pocket 40 which has a front surface, a back surface parallel to and spaced apart from the front surface, and a right, left and bottom side wall which extend between the front and back surfaces of the greeting card, creating the three sided pocket or cavity. A top edge of the pocket 40 is opened to accommodate the insertion and retraction of a pop-up, confetti-retaining element 42. The pocket or cavity 40, in a preferred embodiment, is made of paperboard or other strong but lightweight material. Inside the pocket or cavity 40 is contained a protective cardboard frame for housing 44 or accommodating electronic components, a push button 46 and spring activation mechanism or other activation mechanism, and a pop-up element 42. For example, the frame 44 can be made from one or more pieces of paperboard with appropriate cut-outs or openings can be positioned between the front and back panels of the pocket 40 to hold and secure the mechanical and electronic components of the card. The frame 44 various slots or openings strategically placed thereon to accommodate the various components of the greeting card. In areas where no components are located, a piece of foam, cardboard, paperboard or other material may be used to keep a consistent space between the front and back panels of the frame 44. The pocket 40 may be wrapped, at least partially, by paperboard (or other material) cover 41 which is divided into panels sectioned by fold lines. The paperboard cover 41 extends over the back surface, left side wall and front surface of the pocket 40. The cover 41 may be attached, adhesively or otherwise, to the back surface of the pocket 40. The portion of the cover 41 which extends over the left side wall and the front surface of the pocket 40 is not physically attached to the pocket 40 but merely wraps around the pocket to serve as the front cover and left inside panel of the greeting card 200, as shown in FIG. 12. Alternately, the portion of the cover 41 which extends over the left side wall of the pocket 40 may be attached thereto, adhesively, or otherwise.

The electronic components of the greeting card may include a circuit board 48 with integrated circuit and controller, memory storage device upon which at least one digital audio file is pre-loaded and saved, a power source 50, such as one or more batteries, a speaker 52, related circuitry and any other electronic component which may be required to store and replay one or more audio files, as are known to one with skill in the art.

Figure 14:
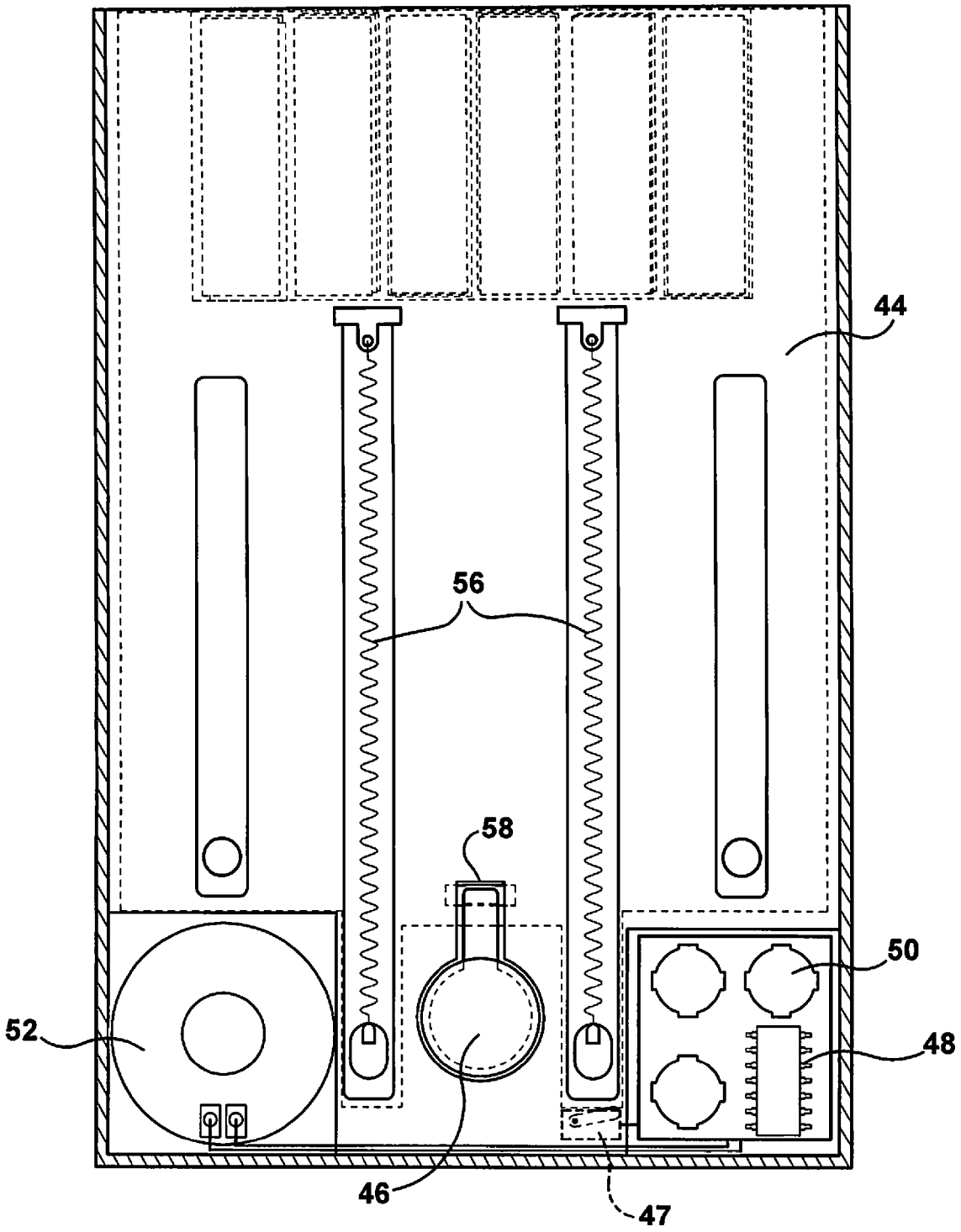
FIG. 14 is a front view of the internal components of the Pop-Up Greeting Card of FIG. 12.
Figure 15:
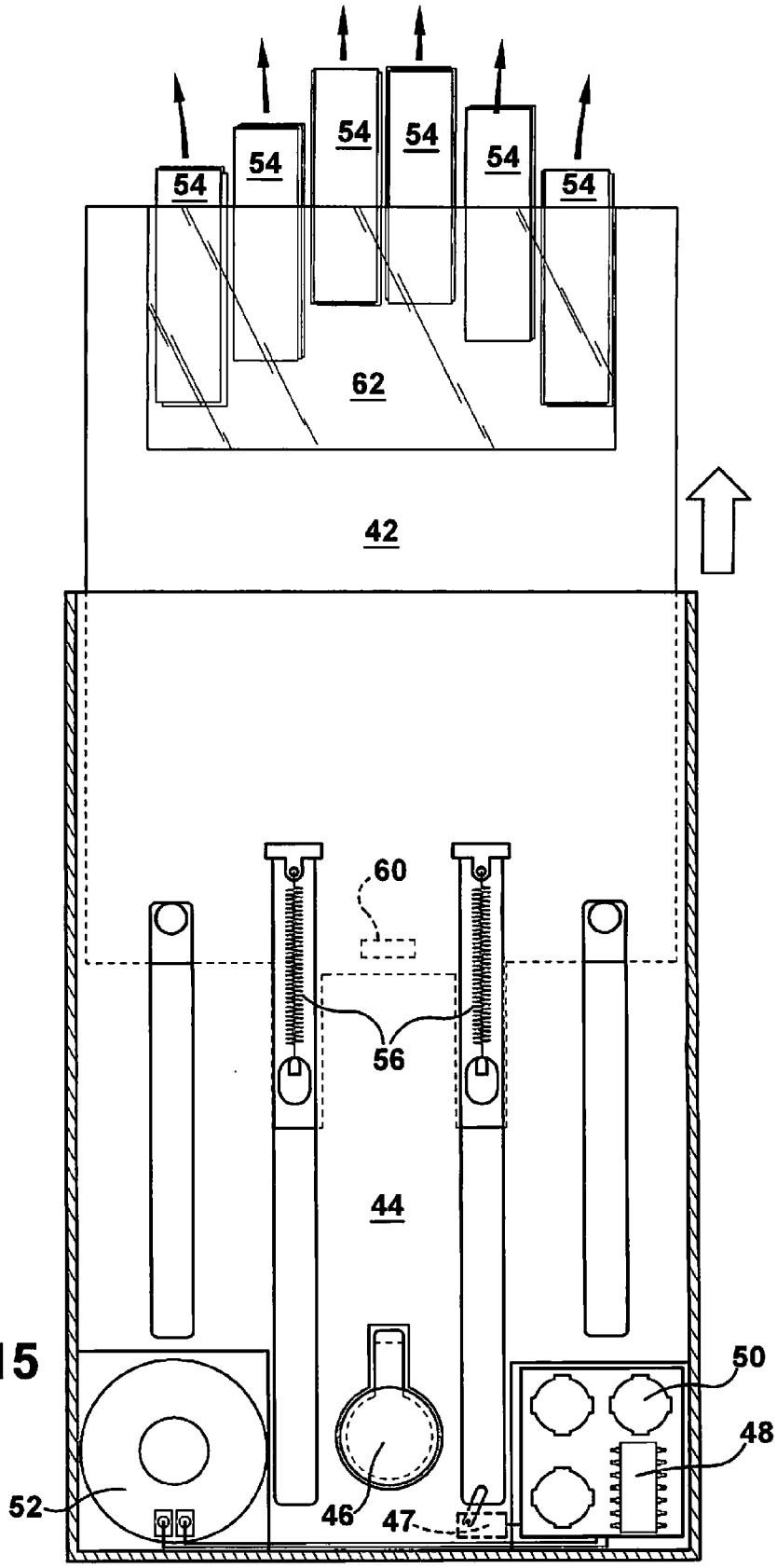
FIG. 15 is a front view of the internal components of the Pop-Up Greeting Card of FIG. 12, with ejected panel and confetti.
Figure 16:
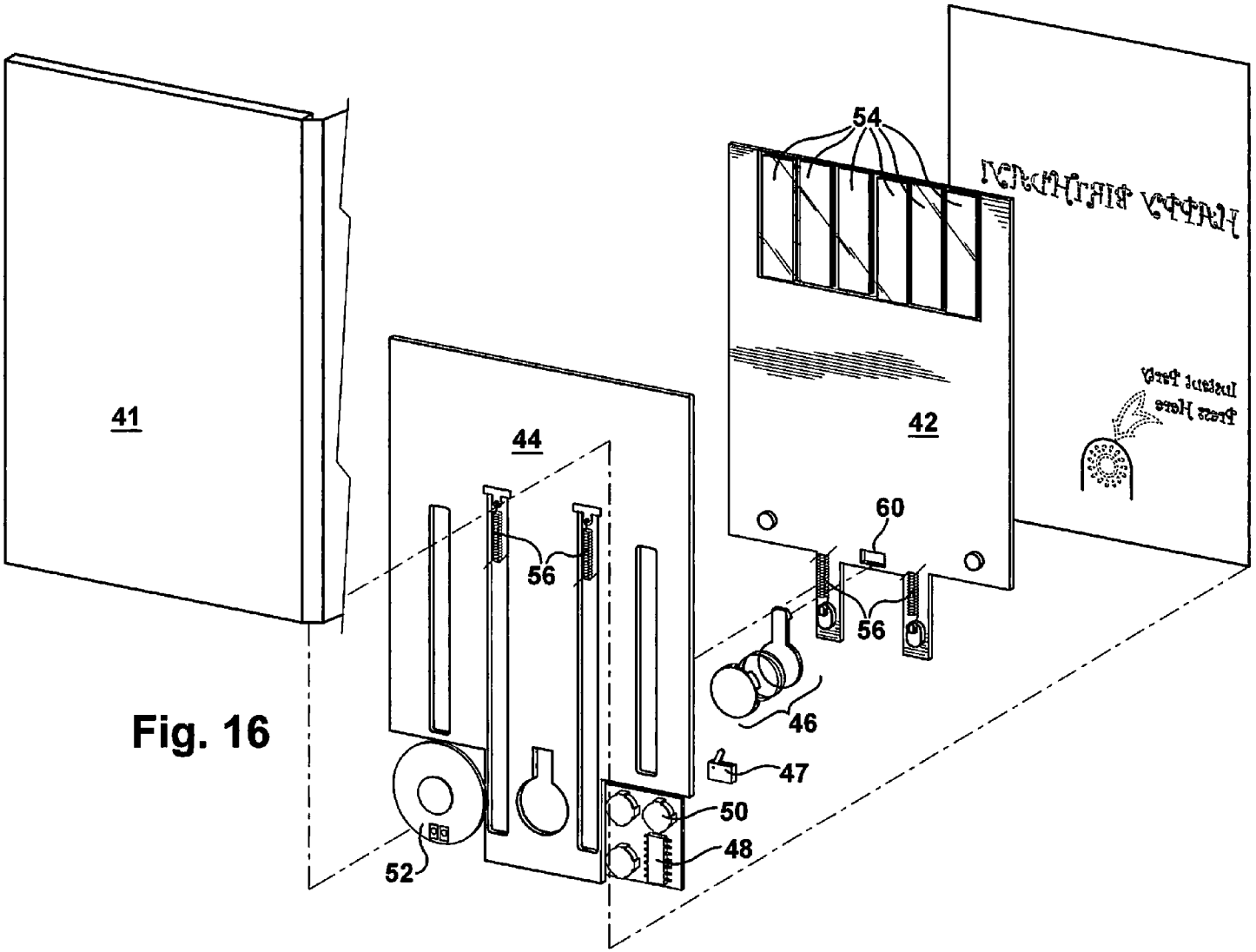
FIG. 16 is an exploded view of the Pop-Up Greeting Card of FIG. 12.

The pop-up element 42, in this particular embodiment, is a narrow cavity or compartment having a front panel and a back panel which contain the confetti 54 therebetween. The front and back panels of the pop-up element 42 may have printed text, such as a birthday greeting and/or drawings or artwork contained thereon. The pop-up element 42 is positioned between the front and back panels of the protective frame 44. The spring loaded mechanism includes two springs 56 which are attached at a first end to the bottom of the pop-up element 42 and at a second end to an upper region of the protective frame 44. When the pop-up element 42 is in a first position substantially concealed within the greeting card, the springs are compressed or stretched. A push button mechanism is contained between the protective panels 44 and contains a push button 46 that is connected to a catch or an arm 58. Words may be printed on the greeting card directing the user to the push button 46. For example, the printing may say something like "instant party, press here". The catch or arm 58 of the push button mechanism 46 contains a lip that extends outward in a forward direction. The pop-up element or inner compartment 42 contains a small opening thereon 60 so that when the pop up element 42 is in a first position substantially concealed within the greeting card, i.e., between the front and back panels of the pocket 40 and within or proximate to the frame 44, the lip of the catch or arm 58 extends into the opening 60 on the pop-up element 42, thereby retaining the pop-up element 42 within the pocket 40 with the springs 56 in an extended position, as shown in FIG. 14. When the push button 46 is depressed it moves the catch or arm 58 causing the lip to become disengaged with the opening 60 on the pop-up element 42 and releasing the extended or stretched springs 56. The mechanical energy stored in the springs 56 when they are in a stretched state, propel or eject the pop-up element 42 upward through the opening along the upper edge of the pocket 40 while releasing the confetti 54. The confetti 54 may be a plurality of strands or bits of paper, small die cut shapes, or any other small, flat, lightweight, paper-like substance. The term confetti also covers streamers, paper discs, spiders, or any other small lightweight item that can be dispersed from the pop-up element 42. The confetti 54 is ejected along with the inner compartment 42 which houses the confetti 54 and then floats to the ground. Prior to purchasing the greeting card at retail, the inner compartment 42 which contains the confetti 54 may have an overlying transparent plastic sheet or wrapping 62 to allow consumers to test the card at retail by pressing the button 46 and having the pop-up element or inner compartment 42 appear. A sticker or other mild adhesive may be used to attach the transparent plastic sheet or cover 62 to the pop-up element 42. Once a consumer purchases the card, he/she may remove the sticker and the plastic sheet 62 before placing the card 200 in the envelope for presentation to the recipient. In addition to causing the pop-up element 42 to be revealed through the top of the greeting card 200 and releasing the confetti 54, the press button 46 also initiates playback of the at least one pre-loaded audio file. The audio is triggered by a small trigger mechanism 47, which contains a lever that is held in place by one of the spring elements 56. The lever pivots about the trigger mechanism 47. When the pop-up-element 42 (to which the spring mechanism 56 is attached) is in the first position, wherein it is contained within the pocket 40, the spring element 56 holds the lever on the trigger mechanism 47 in a first position, as shown in FIG. 14. When the press button 46 is depressed, moving the pop-up element 42 from the first position to a second position, wherein the pop-up element 42 is substantially outside of the pocket 40, the lever is released, allowing it pivot away from the trigger mechanism 47 (as shown in FIG. 15) and allowing the circuit to be completed, thereby initiating playback of at least one audio file. The audio file may contain a spoken message, a song, music, various sounds, etc. When the pop-up element 42 is pushed back down and secured inside the pocket 40, playback of the audio ends. The next time the push button 46 is depressed, the pop-up element 42 will still be ejected from the greeting card 200 but without the confetti 54 that was used on the first push of the button. In another embodiment, the greeting card may be packaged with additional confetti that may be paced by hand inside the greeting card or the envelope.

In still another embodiment, the greeting card of the present invention combines the embodiments shown in FIGS. 9-11 with the embodiment shown in FIGS. 12-16. The pop-up element contains a pocket, as described above with respect to FIGS. 9 and 11, or two or more telescoping pockets or panels, as described above with respect to FIG. 10. The pop-up element also contains confetti, as described above with respect to FIGS. 12-16. This embodiment provides the surprise of the pop-up element and confetti while serving as a carrier or gift card holder. In one embodiment, the gift card is contained within one of the pockets, as described above, or the gift card may be removably attached to the front surface of the pop-up panel while the confetti is dispersed from the inside of the pop-up panel, as described above. In another embodiment, the gift card may be removably attached to the greeting card body, instead of the pop-up panel or cavity.

In still another embodiment, the greeting card of the present invention may include a pop-up element between two panels of the greeting card. Instead of having a large pocket or cavity into which another cavity or pocket (with or without confetti) is inserted, the greeting card may be contain a three-dimensional pop-up element which is contained between two panels of the greeting card. The three-dimensional pop-up element may be moveable between a first position, wherein the pop-up element is folded into a substantially flat, folded configuration between two greeting card panels and a second position, wherein the pop-up element is unfolded into a three-dimensional pop-up structure. The pop-up structure moves between the first and second positions by closing (first position) and opening (second position) the greeting card. Confetti, as described above, can be contained within the three-dimensional pop-up element such that when the greeting card is moved to an open position wherein the pop-up element is unfolded, confetti is released through an opening in the three-dimensional pop-up structure. A retaining mechanism may be contained within the pop-up structure which stores the confetti and releases the confetti upon opening the greeting card. The three-dimensional pop-up structure may be formed into a structure which complements the theme and/or artwork of the greeting card. The confetti contained therein may also take on a particular size, shape and color which is complementary to the overall theme of the greeting card. For example, the pop up structure may be shaped like a box of popcorn, and when the greeting card is opened and the popcorn box is unfolded, confetti is released from within the structure which resembles popcorn. Another example may have the pop-up structure as a can and the confetti shaped like snakes or a pop-up structure as a tornado with confetti shaped like sharks. The pop-up structure and confetti can take on a variety of different shapes, sizes and may be made from a variety of materials. The confetti-releasing mechanism may be operative to release the confetti upon opening the greeting card, as described above, or it may have alternative trigger methods such as a pull string, push button, light sensor, touch sensor, magnetic trigger, or any other such mechanism. The pop-up structure may only release confetti upon the first opening of the greeting card or it may have an opening thereon, through which additional confetti may be inserted for release upon subsequent openings of the greeting card. The confetti release mechanism may also contain a lock mechanism which prevents the release of confetti upon opening the greeting card until the lock mechanism has been opened or released. This prevents the release of confetti upon opening the greeting card at retail prior to purchase or upon opening the greeting card prior to presentation to the greeting card recipient. In addition to releasing confetti, this embodiment may also contain a small pocket or cavity which contains a gift card or other item, as described above with regard to the other embodiments. The pocket or cavity may be ejected or pushed upward from the top of the pop-up structure so the pocket or cavity is visible to the greeting card recipient. As described above with respect to the other embodiments, the pocket or cavity may be transparent so the existence of the gift card therein is immediately recognized. The pocket or cavity may have an opening thereon through which the gift card (or other object) can be inserted and removed. The gift card may be packaged and sold together with the greeting card or the greeting card may be sold with an empty pocket or cavity so that the gift card purchaser can select and purchase a gift card of his/her choice to place within the pocket or cavity of the greeting card.

While the embodiments disclosed herein and shown in the figures have a generally square or rectangular shape, the greeting card may take on any conceivable die cut shape. The greeting card may also be made of alternate material such as plastic or foam. Also, the greeting card has been described and shown as having a press button which is operative to move the inner greeting card panel(s) from within a main pocket to outside the main pocket, however, any type of switch, such as a touch sensitive switch, a slide tongue switch, a light sensitive switch, a motion sensitive switch, a hand crank, a lever or any other mechanical or electromechanical device may be used. Also, the press button switch described herein controls both the movement of the inner panel(s) and also playback of an audio file, however, two separate switches may control the movement of the panel(s) and the playback of audio.

All of the embodiments described herein may additionally contain a USB port, SD card slot or other external memory device port for receiving or uploading audio files from an external source such as a personal computer. The greeting card embodiments disclosed herein may also contain a sentiment panel which is attached to a front or back surface or side of the main pocket or panel and serves as a traditional greeting card that is folded along a fold line and opened along said fold line to reveal a message, artwork, etc. Other additional features which have been contemplated are a microphone for recording a personalized user message for playback upon activation of the press button or other such switch; a motor module for mechanical movement of one or more movable elements which are attached in some way to the greeting card; and one or more LED lights which are visible through the front of the greeting card and which are illuminated upon pressing the press button or other such switch. Combination of the above-mentioned additional special effects or features have also been contemplated and are considered to be within the scope of the present invention.

The disclosure and related inventions thus provide novel card constructions and operations which can be constructed inexpensively and efficiently, and advantageously from primarily paperboard materials configured to securely hold mechanical and electronic components to enable a wide variety of functions and features which enhance the effectiveness of the card as a communication and entertainment device.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A pop-up greeting card comprising:

a greeting card body having a pocket which contains a front surface, a back surface parallel to and spaced apart from the front surface, and a right side wall, left side wall and bottom wall which each extend between the front surface and back surface;

a spring loaded pop-up element located inside the pocket;

a protective frame which is contained within the pocket;

a press button switch operative to cause the spring loaded pop-up element to move between a first position wherein the panel is significantly contained within the pocket and a second position wherein the panel is significantly contained within the pocket and a second position wherein the panel is significantly contained outside the pocket;

wherein the pop-up element contains a plurality of confetti which is released when the pop-up element is moved into the second position.

2. The greeting card of claim 1 further comprising a sound module operative to store and playback at least one audio file.

3. The greeting card of claim 1, wherein the press button switch also causes playback of the at least one audio file.

4. The greeting card of claim 1, wherein the press button switch is accessed through the front surface of the pocket.

5. The greeting card of claim 1, wherein manually pushing the spring loaded pop-up element back into the pocket ends playback of the at least one digital audio file.

6. The greeting card of claim 1, wherein the spring loaded pop-up element contains a messages printed thereon.

7. The greeting card of claim 1, wherein a cover must be removed from the pop-up element before the plurality of confetti may be released upon pressing the press button switch.

8. A greeting card comprising: a main pocket having a front side, a back side parallel to and spaced apart from the front side, and a right side, back side and bottom panel which extend between the front and back sides;

a spring loaded pop-up pocket which is operative to move from a first position wherein the pop-up pocket is substantially contained within the main pocket and a second position wherein the pop-up pocket is substantially outside of the main pocket;

a sound module contained and concealed within the main pocket operative to store and playback at least one audio filed contained therein;

a switch operative to move the pop-up pocket from the first position to the second position;

wherein when the spring loaded pop-up pocket is moved from the first position to the second position, a plurality of confetti is released from the spring loaded pop-up pocket and the at least one audio file is played back, wherein the pop-up pocket contains a greeting printed thereon; and wherein manually pushing the pop-up pocket back into the main pocket causes playback of the at least one audio file to end.

9. The greeting card of claim 8, wherein the pop-up pocket is partially made of a clear or transparent material through which the plurality of confetti is visible.

10. The greeting card of claim 8, wherein the pop-up pocket contains an opening thereon through which the plurality of confetti is released.

11. The greeting card of claim 10, wherein the opening on the pop-up pocket is initially covered by a clear or transparent material through which the plurality of confetti is visible.

12. The greeting card of claim 8, wherein the switch is a press button switch.

13. The greeting card of claim 12, wherein the switch is accessed through the front side of the main pocket.

14. The greeting card of claim 8 further comprising a protective housing contained within the pop-up pocket.

* * * * *